United States Patent [19]

Aviram et al.

[11] Patent Number: 4,470,714

[45] Date of Patent: Sep. 11, 1984

[54] METAL-SEMICONDUCTOR RESISTIVE RIBBON FOR THERMAL TRANSFER PRINTING AND METHOD FOR USING

[75] Inventors: Ari Aviram; Kwang K. Shih, both of Yorktown Heights, N.Y.

[73] Assignee: International Business Machines Corporation, Armonk, N.Y.

[21] Appl. No.: 356,657

[22] Filed: Mar. 10, 1982

[51] Int. Cl.[3] ..... B41J 31/02

[52] U.S. Cl. ..... 400/241.1; 400/120; 428/913; 428/914

[58] Field of Search ..... 400/120, 241, 241.1; 423/344; 428/457, 688, 689, 913, 914; 204/181 C

[56] References Cited

U.S. PATENT DOCUMENTS

| | | | |
|---|---|---|---|
| 1,560,885 | 11/1925 | Walter | 423/344 |
| 2,844,492 | 7/1958 | Fitzer | 423/344 X |
| 2,982,619 | 5/1961 | Long | 423/344 X |
| 3,492,102 | 1/1970 | Bornstein et al. | 428/457 X |
| 3,726,643 | 4/1973 | Merzhanov et al. | 423/344 |
| 3,744,611 | 7/1973 | Montanari et al. | 400/120 |
| 3,979,500 | 9/1976 | Sheppard et al. | 423/344 X |
| 4,251,276 | 2/1981 | Ferree, Jr. et al. | 400/241 X |
| 4,268,368 | 5/1981 | Aviram et al. | 204/181 C |
| 4,308,318 | 12/1981 | Welche | 400/241.1 X |
| 4,309,117 | 1/1982 | Chang et al. | 400/241.1 |
| 4,320,170 | 3/1982 | Findlay | 400/241.1 X |

FOREIGN PATENT DOCUMENTS

| | | | |
|---|---|---|---|
| 792665 | 8/1968 | Canada | 423/344 |
| 0052997 | 5/1978 | Japan | 400/120 |
| 0000177 | 1/1981 | Japan | 400/120 |
| 2010515 | 6/1979 | United Kingdom | 400/241.1 |
| 2072100 | 9/1981 | United Kingdom | 400/120 |

OTHER PUBLICATIONS

IBM Technical Disclosure Bulletin, "Thermal Printer Ribbons", Crooks et al., vol. 18, No. 7, Dec. 1975, p. 2267–2268.

IBM Technical Disclosure Bulletin, "Polypyrrole Toluenesulfonate Films for Resistive Ribbon,38 Diaz et al., vol. 23, No. 12, May 1981, p. 5552.

IBM Technical Disclosure Bulletin, "Thermal Printing Ribbon", Findlay, vol. 24, No. 10, Mar. 1982, p. 5236.

IBM Technical Disclosure Bulletin, "Inorganic Resistive Layer for Electrothermal Printing," Chang, vol. 24, No. 11B, Apr. 1982, p. 6195.

IBM Technical Disclosure Bulletin, "Amorphous Film Printing using D.C. Power and Pulse Selection", Aviram et al., vol. 25, No. 5, Oct. 1982, pp. 2602–2603.

Soviet Powder Metallurgy and Metal Ceramics, "Solid-Phase Synthesis of Some Transition Metal Silicides", Voronov et al., vol. 13, No. 12 (144), pp. 962–965, Published May 1975.

*Primary Examiner*—Ernest T. Wright, Jr.

*Attorney, Agent, or Firm*—Sughrue, Mion, Zinn, Macpeak and Seas

[57] ABSTRACT

A resistive ribbon for thermal transfer printing comprising a support layer bearing a fusible ink composition and a thin aluminum layer upon which is deposited a resistive layer of non-stoichiometric metal silicide is disclosed. Also disclosed are appropriate power sources for using the resistive ribbon, as well as methods for non-impact printing employing the disclosed ribbon.

23 Claims, 2 Drawing Figures

METAL-SEMICONDUCTOR RESISTIVE RIBBON FOR THERMAL TRANSFER PRINTING AND METHOD FOR USING

BACKGROUND OF THE INVENTION

1. Field of the Invention

This invention is directed to a resistive ribbon for thermal transfer printing, and a method of printing employing that ribbon. Specifically, a ribbon bearing a resistive layer of non-stoichiometric metal silicide which may be connected to a voltage controlled power supply to cause resistive heating in the resistive layer at selected points, thereby heating a layer of fusible ink at those points corresponding to area resistively heated is disclosed herein. This ribbon allows for efficient, economical thermal transfer printing, where high quality, low volume printing is desired.

2. Description of the Prior Art

The art of non-impact printing is becoming increasingly popular as a method for producing high quality written materials, where such characteristics are desirable. Among the non-impact printing modes, thermal transfer printing has proved particularly desirable where high quality, low volume printing is necessary, such as in computer terminals and typewriters. In thermal transfer printing, ink is printed on the face of a receiving material whenever a fusible ink layer brought in contact with the receiving surface is softened by a source of thermal energy. The thermal energy is supplied from a source of electricity, the electrical energy being converted to thermal energy.

One device employed for thermal transfer printing is a thin ribbon, or resistive ribbon, which bears a layer of fusible ink that is brought into contact with the receiving surface on one side, and on the other side of the ribbon is a layer of resistive material which is typically brought in contact with an electrical power supply and selectively contacted by a thin printing stylus at those points opposite the receiving surface that are desired to be printed. When the resistive layer is thus contacted, resistive heating results, which heating results in the local melting of the fusible ink layer. Such a ribbon is generally discussed in U.S. Pat. No. 3,744,611, Montanari et al.

Prior art attempts to provide such a resistive ribbon for thermal transfer printing have typically encountered significant limitations. Among other obstacles, the material selected to support both the fusible ink and the resistive layer has been difficult to adhere to the other layers of the ribbon. Additionally, the same supporting layer may act as a thermal barrier to the transfer of heat from the resistive layer to the ink layer, thereby frustrating the printing process. Additionally, the resistive layers of these ribbons, typically graphite dispersed in a binder, required so much energy for heating that the layer might be burned through before printing occurred.

Accordingly, it is the object of this invention to provide a resistive ribbon for thermal transfer printing and a method for using that ribbon which results in economical, efficient and high quality printing.

Another object of this invention is to provide a ribbon which requires much less energy for resistive heating to achieve printing.

Still a further object of this invention is to provide a film that is thinner than the prior art, so that more ribbon can be packed into a single unit.

Yet a further object is to provide a resistive layer that will not release toxic materials or burn through.

Yet another object of this invention is to provide a resistive layer employing inorganic media such that the use of toxic solvents in manufacturing may be avoided.

SUMMARY OF THE INVENTION

The article and process disclosed and claimed herein is based on the discovery that inorganic resistive layers, preferably comprised of a binary alloy can be conveniently provided on a resistive ribbon suitable for thermal transfer printing in very thin layers, that can be conveniently heated by application of a voltage controlled power supply operated in 200 microsecond pulses to achieve resistive heating. The ribbon claimed herein consists of a support layer of Mylar or equivalent material which may support a very thin layer of aluminum. Where the aluminum layer is present, there is then applied the silicide resistive layer, which is contacted by electrodes attached to the power supply. In those embodiments where the aluminum layer is absent, the resistive layer is applied directly on the support. On the surface of the support layer opposite the aluminum, a layer of fusible ink is applied.

By supplying power to a stylus that may be brought into electrical contact with the resistive layer in contact with a ground electrode, when the thin wire stylus is applied to those regions of the ribbon opposite which the surface of a receiving material in contact with the fusible ink layer local resistive heating occurs. Upon resistive heating, the fusible ink layer is heated, where, upon melting, the now liquid ink is transferred to the receiving material.

DETAILED DESCRIPTION OF THE INVENTION

Figure 1:
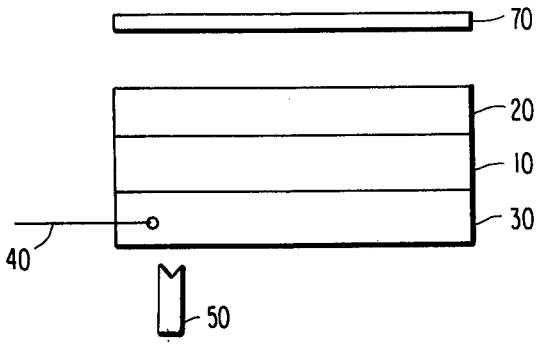
FIGS. 1 and 2 are cross-sectional views of illustrative resistive ribbons per the present invention shown in their environment of use.

FIG. 1 shows a three layer ribbon per the present invention where support 10 is shown coated on one side with fusible ink 20 and on the other side with inorganic resistive material 30. Also shown is ground electrode 40 attached to inorganic resistive layer 30 and one stylus 50 which would be attached to a power supply (not shown).

Figure 2:
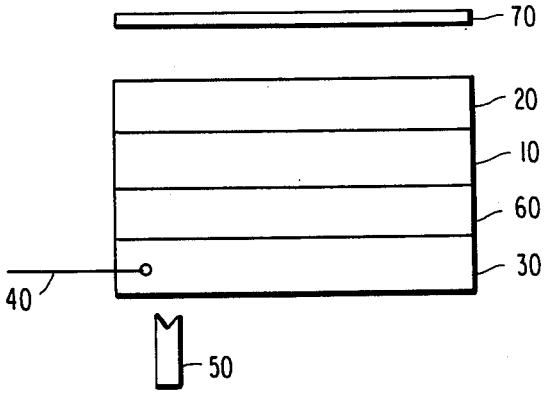

FIG. 2 illustrates a four layer ribbon per the present invention wherein all numerals identify like elements to those shown in FIG. 1; there is also shown in FIG. 2 aluminum layer 60 interposed between support 10 and the layer of inorganic resistive material 30.

In both FIGS. 1 and 2 a material to be printed 70 is shown disposed opposite the layer of fusible ink 20.

The resistive ribbon of this invention may be comprised of three or four layers. The four layer embodiment, including a thin layer of aluminum, is preferred. These four layers may be adhered to each other by any convenient means including methods of thin film deposition and application of binders or other materials having good adhering qualities.

The support layer of the resistive ribbon of this invention must be comprised of a non-conductive material which ideally is flexible enough to allow the formation of spools or other "wrapped" packages for storage and shipping, yet be capable of supporting the remaining layers of the ribbon. Additionally, the support layer should be formed of a material which does not significantly impede the transfer of thermal energy from the resistive layer on one side of the support layer to the fusible ink layer on the other side, as this decreases the efficiency of printing, and requires more energy to do the same work. Although any number of materials may be employed as the support layer, which will occur to one of ordinary skill in the art, preferred materials include Mylar, polyethylene, polysulfones, polypropylene, polycarbonate, polyvinylidene fluoride, polyvinylidene chloride, polyvinyl chloride or kapton. A particularly preferred material is Mylar.

Although the thickness of the support layers, and all layers of the ribbon is controlled to some degree by the required transfer of thermal energy and the ability to store the material, as well as the machinery with which it must be used, such as a computer terminal or typewriter, the support layer is preferably 0.1 mil-0.2 mil in thickness.

One surface of the support layers bears a printing or ink composition. It is this fusible composition which, although not flowing at room temperature, upon heating will become transferrable, such that when contacted with the surface to be printed, will be transferred from the ribbon to the surface. As with the support layer, a number of fusible ink compositions will occur to those of ordinary skill in the art. One particularly preferred layer is a Versamide/carbon mixture, which melts at approximately 90° C. This ink composition, and others, are fully disclosed in U.S. Pat. No. 4,268,368 which is incorporated by reference herein. The fusible ink layer should be approximately 4–6 microns in thickness, preferably, about 5 microns.

The support layer may be coated with the fusible ink composition by any of a number of well-known coating methods, such as roll or spray coating.

On the surface opposite the fusible ink composition, in the four layer embodiment the support layer bears a very thin layer of aluminum, preferably of from 500Å–2000Å. A particularly preferred thickness is approximately 1000Å.

Applied to the free surface of the support layer in the 3 layer embodiment, and that of the aluminum layer when present, is the resistive layer of the ribbon, which is of critical importance to this invention. We have discovered that a wide range of inorganic materials may be employed as the resistive layer to achieve the objects of this invention. Particularly, binary alloys, wherein one or both of the alloy components is a metal, M, are preferred. Particulary preferred are non-stoichiometric metal silicides, represented as $M_{1-X}Si_X$, although this invention is not intended to be limited thereby. Generally, any of a number of compounds of Groups III and IV of the Periodic Table may be paired with a metal in the inorganic resistive layer. These resistive materials can be employed to induce resistive heating at very low energy inputs, thereby overcoming the prior art disadvantages described above. Additionally, these resistive materials need not be supported in a polymeric binder, as is the case in many prior art embodiments, and therefore the "burn through" phenomenon observed when continued resistive heating burned out the binder of prior art ribbons can be avoided. Additionally, toxic fumes released from such polymeric binders are not encountered in the claimed invention.

The metals that may be employed in the resistive layer of the ribbon may be virtually any metal which will not, when in the form of a binary alloy, explosively or harmfully or otherwise chemically react upon resistive heating. As a preferred embodiment, any of a number of metals may be employed in the metal silicides which may comprise the resistive layer. Such metals include, but are not limited to, nickel, cobalt, chromium, titanium, tungsten, molybdenum and copper. Particularly preferred metals for this invention include nickel, cobalt, chromium and titanium.

The composition of the metal silicides of the claimed invention may vary within ranges, as may be determined by one of ordinary skill in the art through simple and routine experimentation. As the important aspect of the resistive layer is its ability to undergo resistive heating, the composition of the metal silicide should be selected on the basis of its resistivity. Generally, the metal silicide resistive layer may exhibit a resistivity of approximately 100--5000 ohm-centimeters for a 1 micron thick layer.

Although, as noted, one of ordinary skill in the art may determine appropriate compositions for the inorganic resistive materials to achieve these values by routine experimentation, exemplary values for x in the formula $M_{1-X}Si_X$ in selected compositions have been determined. Thus, when M is Ni, x may vary between about 0.84 and 0.97. When M is tungsten, operable ranges for x are 0.88–0.98. Similarly, when M is titanium, x may vary from about 0.90 to 0.96. These values are included as examples only, and are not intended to limit the scope of this invention. Similar values may be obtained for other binary alloys.

Although the thickness of the resistive layer of the claimed invention may be varied depending upon its environment, a preferred range is about 0.5 microns–2 microns in thickness. A particularly preferred thickness is about 1 micron. The resistive layers may be applied to the aluminum side of the aluminized Mylar, or directly to the Mylar in the 3 layer embodiment, by any of a number of thin film deposition methods which are well known in the art. Exemplary among these methods are vacuum evaporation and sputtering. When applying the resistive layer by vacuum evaporation, either a single source or double source may be employed.

The total thickness of the ribbon of this invention is therefore only slightly more than 10 microns, in contrast to prior art ribbons ranging from 20–30 microns in thickness.

Some of the binary alloys described hereinabove exhibit an important "switching behavior" when an aluminum underlayer is present. At initial voltages, high impedance is exhibited. However, when a certain voltage is reached, which voltage may vary for each particular metal silicide composition, the resistive material "switches" to low impedance behavior. As a result, a holding voltage, whereat the current applied through the resistive layer sharply increases is experienced. This holding voltage is characteristically about 1½ to less than 2 volts. As a result of this "switching behavior", printing employing the resistive ribbons of this invention can be achieved by constant current power sources only with difficulty. Such sources automatically cut off when a pre-set current is reached. As the resistive layers of this invention commonly require at least 60 milliwatts in pulses of 200 microseconds to induce sufficient resistive heating to heat the fusible ink layer to 90° C., therefore, altough constant current power sources may be employed, constant voltage power sources are preferred.

Generally, such power supplies may be set to whatever current is desired to induce resistive heating. Although the power supplied may be varied to achieve optimum printing, by routine experimentation, printing may generally be effected at 60 milliwatts or greater, with 200 microsecond pulses.

When printing with the resistive ribbon claimed herein, the power supply is preferably applied to a thin stylus, through the resistive layer of the ribbon to a ground electrode in contact therewith. To effect selective resistance heating and therefore local melting of the ink, the thin stylus, generally tungsten or stainless steel, may be applied at those points opposite which the ink is desired to be melted. Whenever the fusible ink composition is in contact with a surface to be printed, and resistance heating is applied, the ink opposite the area where resistance heating has been induced by contact with the stylus will be melted and thereby transferred to the surface in contact with it.

It will be seen that the resistive ribbon disclosed herein not only allows for thermal transfer printing at low energy levels without the attendant obstacles and disadvantages previously experienced, but, when made within the parameters disclosed above, is advantageously two to three times thinner than ribbons currently employed, allowing for significant economic savings.

As indicated, the precise values and processes described above are merely representative of the range of values and embodiments which could be used in practicing this invention. It is to be understood therefore, that specifically mentioned apparatus and materials are illustrative only, and that any changes made, especially as to matters of shape, size and arrangement, to the full extent of the general meaning of the terms in which the appended claims are expressed, are within the principle of the invention.

We claim:

1. A resistive ribbon for thermal transfer printing, comprising:

a support layer bearing on a first side a layer of fusible ink composition and bearing on the side opposite said first side a layer of inorganic resistive material selected from the group consisting of a binary alloy, a metal and a compound selected from Groups III or IV of the Periodic Table, and a non-stoichiometric metal silicide.

2. The resistive ribbon of claim 1, wherein a thin layer of aluminum is interposed between said support layer and said resistive material.

3. The resistive ribbon of claims 1 or 2, wherein said inorganic resistive material is said binary alloy.

4. The resistive ribbon of claim 1 or 2, wherein said inorganic resistive material is said metal and said compound of Groups III or IV of the Periodic Table.

5. The resistive ribbon of claim 1 wherein said ribbon has a total thickness of approximately 10 microns, wherein said support layer is about 0.1–0.2 mils in thickness, said fusible ink composition layer is about 4–6 microns thick and said resistive material layer is about 0.5–2 microns in thickness.

6. A resistive ribbon for thermal transfer printing, comprising:

a support layer bearing on a first side a layer of fusible ink composition and bearing on the side opposite said first side a layer of resistive material comprising a non-stoichiometric metal silicide.

7. The resistive ribbon of claim 6 wherein said ribbon has a total thickness of approximately 10 microns, wherein said support layer is about 0.1–0.2 mil in thickness, said fusible ink composition layer is about 4–6 microns thick and said resistive material layer is about 0.5–2 microns in thickness.

8. A resistive ribbon for thermal transfer printing, comprising:

a support layer bearing on a first side a thin layer of aluminum and on the side opposite said first side a layer of fusible ink composition and wherein said thin layer of aluminum bears on the face opposite that in contact with said support layer a layer of resistive material comprising a non-stoichiometric metal silicide.

9. The resistive ribbon of claim 6 or 8, wherein said metal silicide is selected from the group consisting of $Ni_{1-x}Si_x$, $Co_{1-x}Si_x$, $Cr_{1-x}Si_x$, $Ti_{1-x}Si_x$, $W_{1-x}Si_x$, $Mo_{1-x}Si_x$, and $Cu_{1-x}Si_x$.

10. The resistive ribbon of claim 6 or 8, wherein said metal silicide is selected from the group consisting of $Ni_{1-x}Si_x$, $Co_{1-x}Si_x$, $Cr_{1-x}Si_x$ and $Ti_{1-x}Si_x$.

11. The resistive ribbon of claim 6 or 8, wherein said layer of resistive material has a resistivity of 100–5000 ohm-centimeters.

12. The resistive ribbon of claim 1, 2, 6 or 8, wherein said support layer is comprised of Mylar, polyethylene, polysulfones, polypropylene, polycarbonate, polyvinylidene fluoride, polyvinylidene chloride, polyvinyl chloride, or kapton.

13. The resistive ribbon of claim 2, 6 or 8, wherein said ribbon has a total thickness of approximately 10 microns.

14. The resistive ribbon of claim 13, wherein said support layer is about 0.1–0.2 mils in thickness, said fusible ink composition layer is about 4– 6 microns thick, said aluminum layer is 500–2000Å thick, and said resistive material layer is about 0.5–2 microns in thickness.

15. The resistive ribbon of claim 1, 2, 6 or 8, wherein said resistive layer is in electrical contact with a ground electrode and one or more thin wire styluses, said styluses being connected to a power supply.

16. A method of thermal transfer printing which comprises supplying electricity in pulses from a power supply to one or more styluses, said styluses being susceptible of being brought in electrical contact with a resistive ribbon comprised of a layer of resistive inorganic material electrically contacting a ground electrode which layer is adjacent a support layer the remaining surface of which support layer bears a layer of fusible ink composition, selected from the group consisting of a binary alloy, a metal and a compound selected from Groups III or IV of the Periodic Table, and a non-stoichiometric metal silicide, contacting said fusible ink with material to be printed, and selectively contacting said resistive layer with said styluses opposite those portions of the material to be printed where ink is desired to be transferred so as to cause resistive heating in said resistive layer, thereby locally heating said fusible ink composition.

17. The method of claim 16, wherein said resistive ribbon has a thin aluminum layer interposed between said support and resistive material layers.

18. The method of claims 14 or 15, wherein said resistive inorganic material is said binary alloy.

19. The method of claim 16 or 17, wherein said inorganic resistive material is said metal and said compound of Groups III or IV of the Periodic Table.

20. The method of claim 16 or 17, wherein said inorganic resistive material is said metal silicide.

21. The method of claim 16 or 17, wherein said pulses are approximately 200 microseconds in duration.

22. The method of claim 20, wherein said metal silicide is selected from the group consisting of $Ni_{1-x}Si_x$, $Co_{1-x}Si_x$, $Cr_{1-x}Si_x$, $Ti_{1-x}Si_x$, $W_{1-x}Si_x$, $Mo_{1-x}Si_x$, and $Cu_{1-x}Si_x$.

23. The method of claim 20, wherein said metal silicide is selected from the group consisting of $Ni_{1-x}Si_x$, $Co_{1-x}Si_x$, $Cr_{1-x}Si_x$, and $Ti_{1-x}Si_x$.

* * * * *

UNITED STATES PATENT AND TRADEMARK OFFICE

CERTIFICATE OF CORRECTION

PATENT NO. : 4,470,714

DATED : Sept. 11, 1984

INVENTOR(S) : AVI AVIRAM ET AL

It is certified that error appears in the above-identified patent and that said Letters Patent is hereby corrected as shown below:

Claim 13, line 1, delete "6".

Claim 18, line 1, "14 or 15" should read --16 or 17--.

Signed and Sealed this

*Twenty-fifth* Day of *June 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,470,714

DATED : September 11, 1984

INVENTOR(S) : Ari Aviram; Kwang K. Shih

It is certified that error appears in the above-identified patent and that said Letters Patent is hereby corrected as shown below:

Column 1, line 16, kindly delete "area" and substitute therefor --areas--.

Column 2, line 3, after "can", kindly insert --conveniently--;

line 37, kindly delete "DRAWING" and substitute therefor --DRAWINGS--.

Column 5, line 23, after "will", kindly insert --thus--.

Column 6, line 5, kindly delete "mil" and substitute therefor --mils--.

Signed and Sealed this

*Twenty-second* Day of *October 1985*

[SEAL]

*Attest:*

DONALD J. QUIGG

*Attesting Officer*

*Commissioner of Patents and Trademarks—Designate*